US005839574A

United States Patent [19]

Lorence et al.

[11] Patent Number: 5,839,574

[45] Date of Patent: Nov. 24, 1998

[54] FROZEN FOOD TRAY AND CARTON ENSEMBLE

[75] Inventors: Matthew W. Lorence; James E. Grace, both of Omaha, Nebr.

[73] Assignee: ConAgra, Inc., Omaha, Nebr.

[21] Appl. No.: 566,011

[22] Filed: Dec. 1, 1995

[51] Int. Cl.[6] ..... B65D 43/00

[52] U.S. Cl. ..... 206/216; 206/557; 426/110; 426/112

[58] Field of Search ..... 206/216, 557, 206/564; 229/125.33, 125.35, 231, 232, 233, 234, 123.1; 426/106, 110, 112

[56] References Cited

U.S. PATENT DOCUMENTS 3,281,051 10/1966 O'Brien et al. .
3,349,985 10/1967 Salway .
3,411,696 11/1968 Ayer et al. .
3,442,662 5/1969 Robinson .
3,495,758 2/1970 Wienecke, Jr. .
3,705,681 12/1972 Rossi et al. .
3,730,338 5/1973 Chesky .
3,862,703 1/1975 Dutcher .
3,868,017 2/1975 Carveth .
4,221,320 9/1980 Faller .
4,228,945 10/1980 Wysocki .
4,252,268 2/1981 Haire .
4,257,530 3/1981 Faller .
4,590,349 5/1986 Brown et al. .
4,674,633 6/1987 Steadman .
4,703,148 10/1987 Mikulski et al. .
4,785,160 11/1988 Hart .
4,801,017 1/1989 Artusi .
4,821,884 4/1989 Griffin et al. .
4,834,247 5/1989 Oshima et al. .
4,870,233 9/1989 McDonald et al. .
4,876,427 10/1989 Mode .
4,880,112 11/1989 Conrad .
4,889,239 12/1989 Sandish et al. .
4,903,842 2/1990 Tokuda et al. .
4,925,035 5/1990 Hunninghaus .
4,939,332 7/1990 Hahn .
4,955,530 9/1990 Rigby et al. .
4,962,849 10/1990 Anderson .
5,011,006 4/1991 Anderson .
5,090,615 2/1992 Hopkins et al. .
5,197,657 3/1993 Cassidy et al. .
5,234,159 8/1993 Lorence et al. .
5,242,106 9/1993 Gulliver .

*Primary Examiner*—Jacob K. Ackun
*Attorney, Agent, or Firm*—Brinks Hofer Gilson & Lione

[57] ABSTRACT

A carton for enclosing an object which has a top face defining a plane and having a first edge, a second edge, a third edge and a fourth edge. The carton further includes a first side panel attached to the first edge and angled relative to the plane, a second side panel attached to the second edge and angled relative to the plane, a third side panel attached to the third edge and having a planar portion which is parallel to and offset from the plane and a fourth side panel attached to the fourth edge. The first, second, third and fourth side panels each have an unattached edge, where the unattached edges define an opening which is substantially parallel to the planar portion.

48 Claims, 9 Drawing Sheets

FROZEN FOOD TRAY AND CARTON ENSEMBLE

BACKGROUND OF THE INVENTION

This invention relates to a frozen food tray and carton ensemble for containing frozen food items, such as meat and vegetables.

A common problem with such ensembles is that they fail to minimize the amount of material used to construct the carton.

Another problem present in some ensembles is that they force people to eat the food out of a box instead of a more aesthetically pleasing manner like out of a tray.

Furthermore, many tray and carton ensembles fail to have structures which are conducive to having the ensemble stacked on end and/or pushed against each other while moving along a conveyor in the manufacturing process.

Accordingly, it is an object of the present invention to provide a structure for a carton which lessens the material needed to enclose and support a tray.

Another object of the present invention is to provide a frozen food tray and carton ensemble which allows the user to easily remove the tray for eating.

A third object of the present invention is to provide an ensemble structure that allows the ensemble to be stacked on end.

A fourth object of the present invention is that it allows ensembles lying on a conveyor to effectively push each other while moving on the conveyor.

SUMMARY OF THE INVENTION

One or more of the above-mentioned objects along with other objects, are accomplished by a carton that has a top face defining a plane and having a first edge, a second edge, a third edge and a fourth edge. The carton further includes a first side panel attached to the first edge and angled relative to the plane, a second side panel attached to the second edge and angled relative to the plane, a third side panel attached to the third edge and having a planar portion which is parallel to and offset from the plane and a fourth side panel attached to the fourth edge. The first, second, third and fourth side panels each have an unattached edge, where the unattached edges define an opening which is substantially parallel to the planar portion.

Another aspect of the present invention includes a tray and carton ensemble with a tray having one or more compartments for receiving one or more food items and a carton having a top face having a first edge and a second edge. The carton further includes a first side panel attached to the first edge and having a planar portion which is parallel to and offset from the plane and a second side panel attached to the second edge and having a second planar portion which is parallel to and offset from the plane. The top face and the first and second planar portions are separated from each other by an bounded opening. Furthermore, the top face and the first and second planar portions define a volume of space where the tray is contained within the volume of space.

Both aspects of the present invention provide the advantage of reducing the amount of material necessary to both enclose and support a tray while at the same time providing sufficient strength to allow stacking and pushing of a tray and carton ensemble.

The invention is illustrated more or less diagrammatically in the following drawings wherein:

DESCRIPTION OF THE PREFERRED EMBODIMENTS

Figure 1:
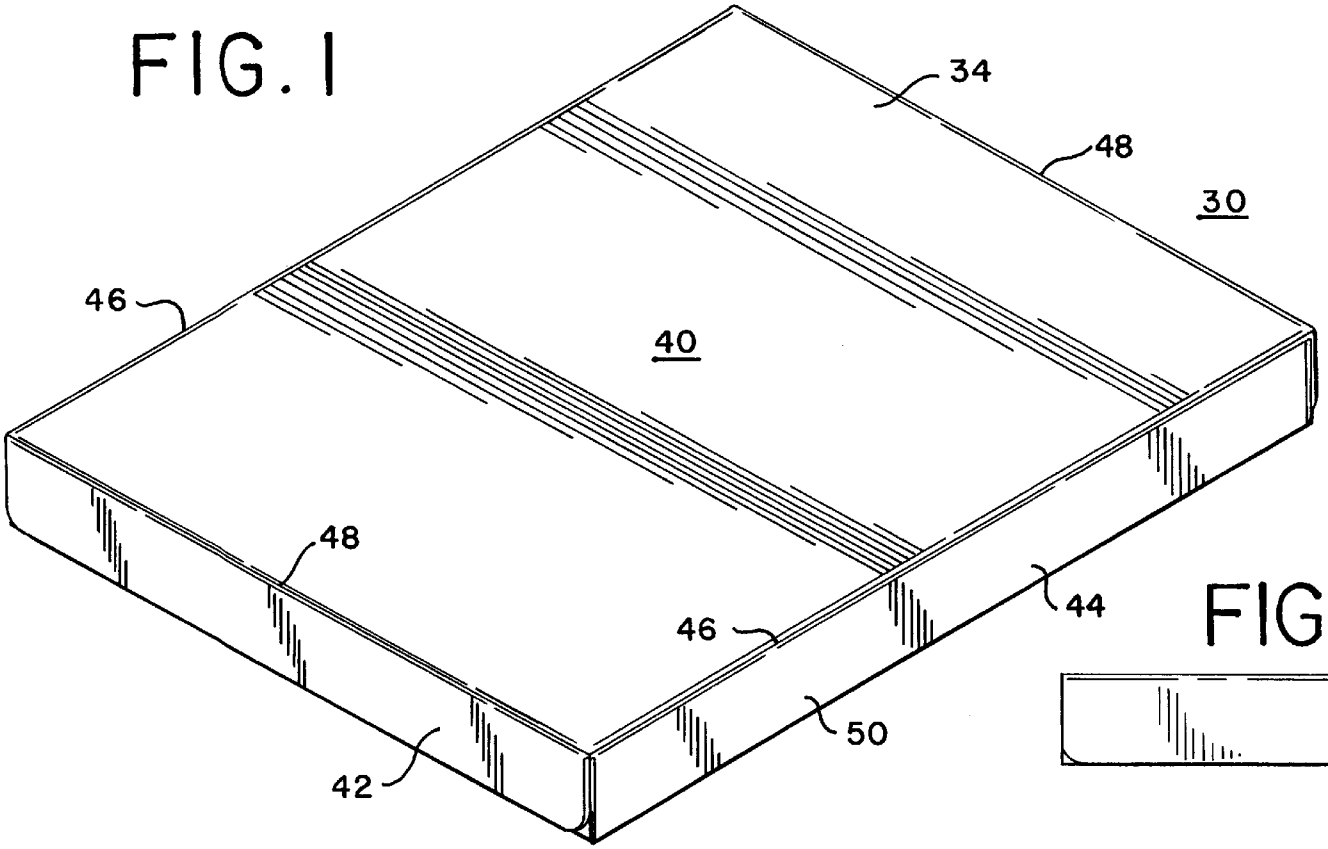
FIG. 1 generally shows a top perspective view of frozen food tray and carton ensemble according to the present invention.

Several tray and carton ensembles 30 employing the present invention are shown in FIGS. 1–19, where like elements are denoted by like numerals. In particular, FIGS. 1–9 show a tray and carton ensemble 30 which includes a tray 32 contained within a volume of space defined by carton 34. Tray 32 is rectangular in shape and has one or more compartments 36 for receiving one or more food items.

Figure 7:
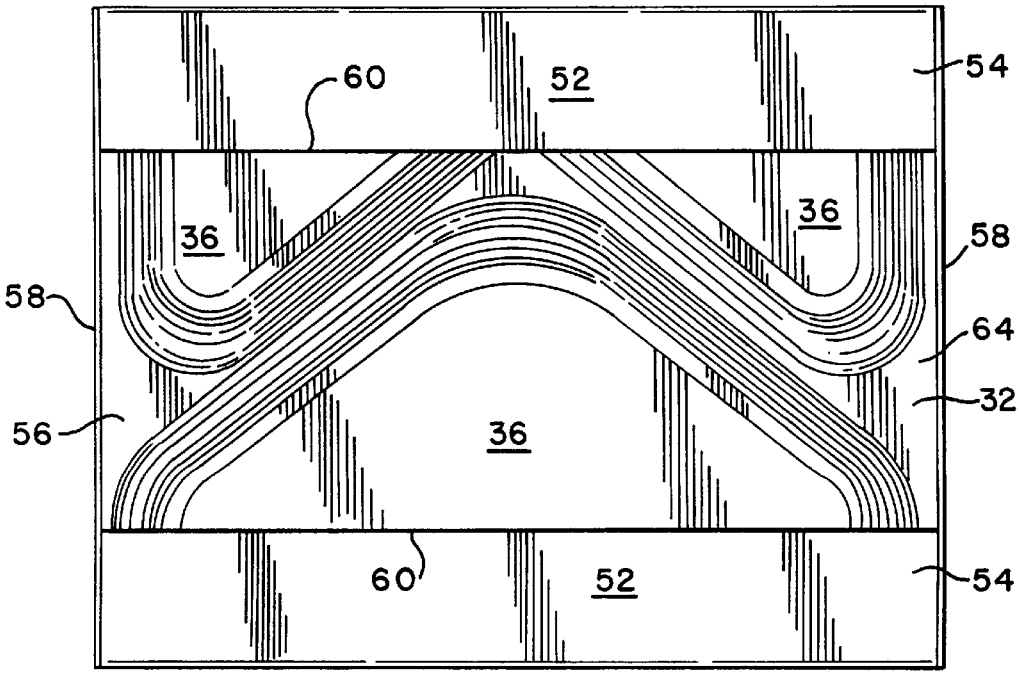
FIG. 7 shows a bottom view of the frozen food tray and carton ensemble of FIG. 1.
Figure 8:
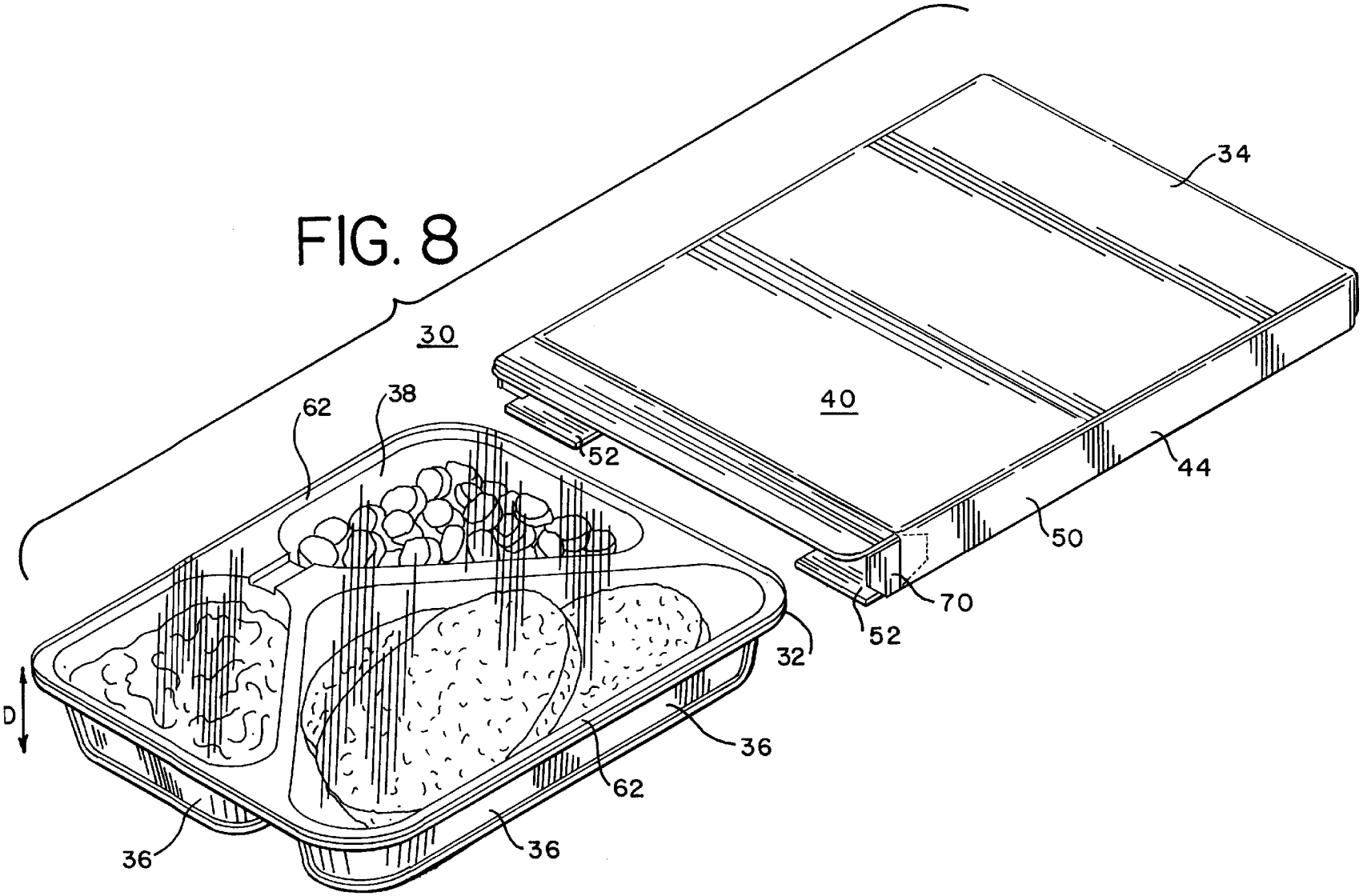
FIG. 8 shows a top perspective view of a frozen food tray and carton ensemble when the tray is removed from the carton or the tray is being inserted into the carton.

Preferably, tray 32 is made of a sheet of 21 point ("0.021" thickness) milk carton stock extrusion coated with polyester. The sheet is press formed into a desired shape. As seen in FIGS. 7 and 8, tray 32 has three compartments and has a length of approximately 9", a width of approximately 7" and a depth of approximately 13/16". Of course, tray 32 can be made in many well-known ways and made out of many well-known materials, such as paperboard, crystallized polyester (CPET), polypropylene (PP), high density polyethylene (HDPE) or molded paper pulp. Furthermore, tray 32 may include a lidding material, such as polyester or aluminum foil 38, to enclose the compartments 36. Lidding material 38 may be rectangular in shape and-attached to the flanges of tray 32 by applying heat, crimping, or other methods well known in the art.

As shown by FIGS. 7 and 8, tray 32 is inserted into and contained within a volume of space defined by a top face 40, a pair of end side panels 42, and a pair of lateral side panels 44 of carton 34. Carton 34 may be made of a variety of materials, such as paperboard. Preferably, carton 34 is made of 14 point (thickness of 0.014") solid unbleached sulfate (SUS).

Figure 3:
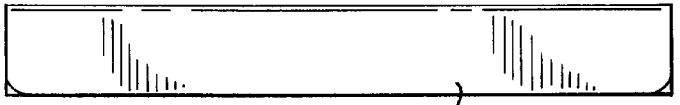
FIG. 3 shows a front view of the frozen food tray and carton ensemble of FIG. 1.
Figure 4:
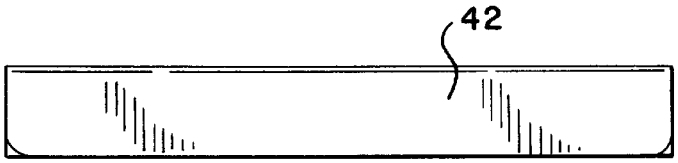
FIG. 4 shows a rear view of the frozen food tray and carton ensemble of FIG. 1.
Figure 2:
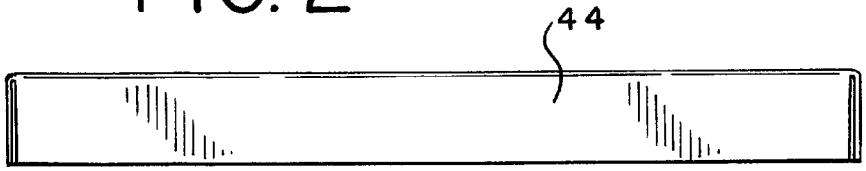
FIG. 2 shows a left side view of the frozen food tray and carton ensemble of FIG. 1.
Figure 5:
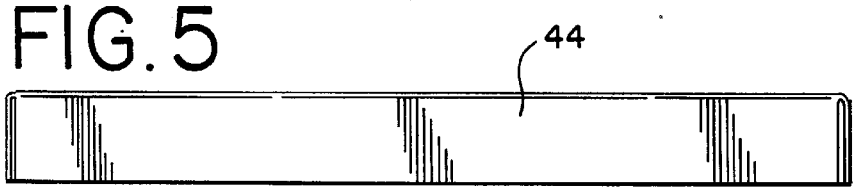
FIG. 5 shows a right side view of the frozen food tray and carton ensemble of FIG. 1.
Figure 6:
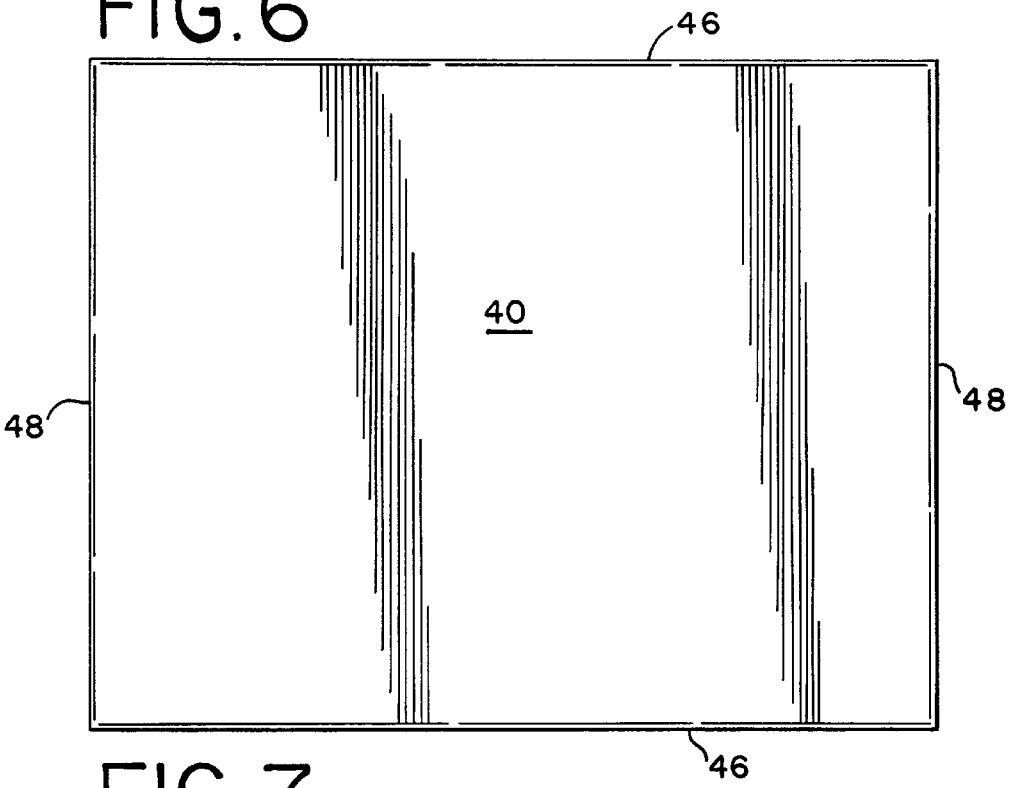
FIG. 6 shows a top view of the frozen food tray and carton ensemble of FIG. 1.
Figure 10:
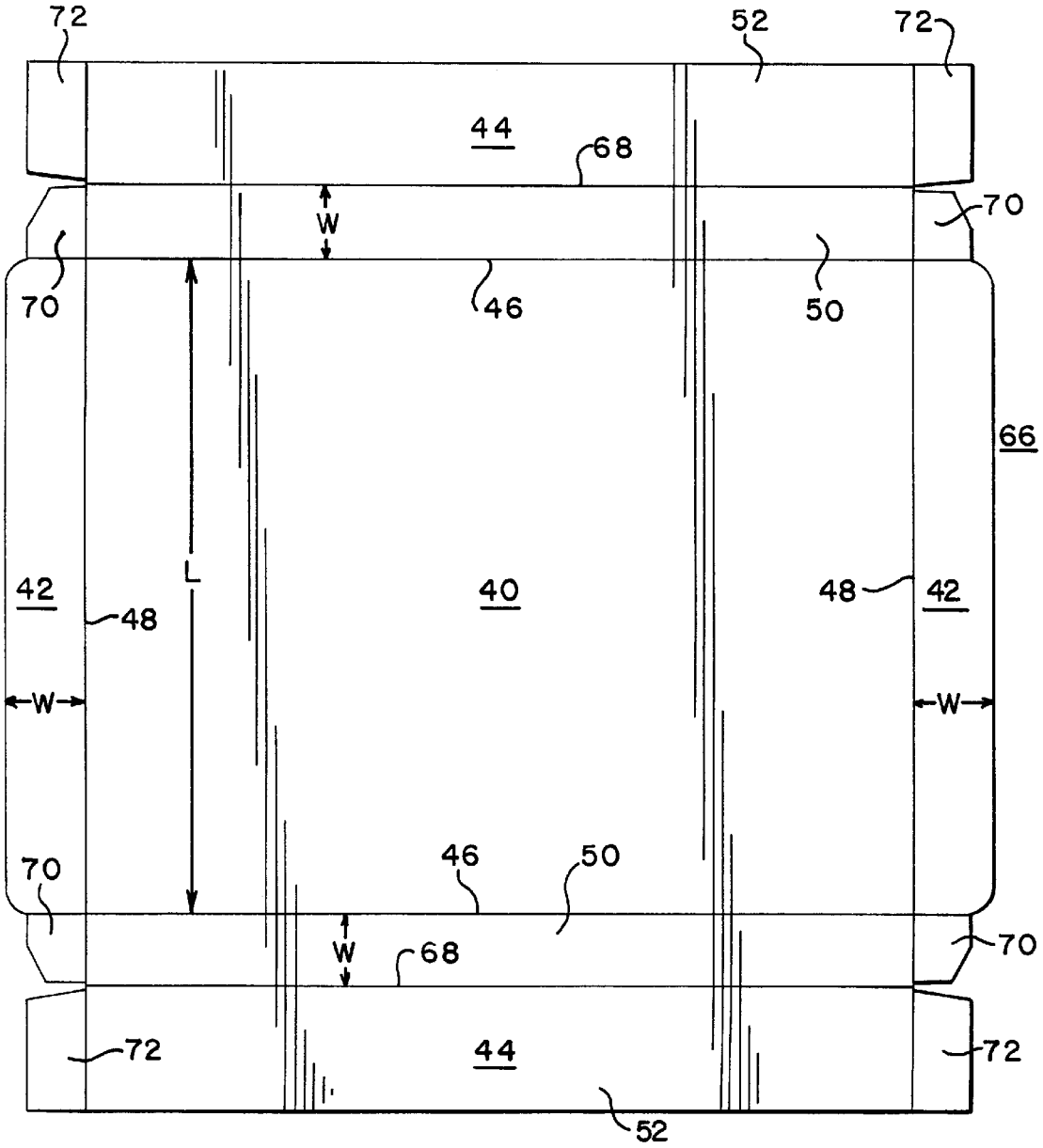
FIG. 10 shows an unfolded view of the frozen food carton of FIGS. 1–8.

Top face 40 of carton 34 preferably is rectangular in shape and has a pair of lateral edges 46, each edge 46 having a length of approximately 9 1/16". Lateral edges 46 are attached to lateral side panels 44. Top face 40 further includes a pair of side edges 48 which are attached to the end side panels 42. Each side edge 48 has a length of approximately 7 1/16". Each end side panel 42 preferably is rectangular-like in shape having a length of approximately 7 1/16" and a width of approximately 13/16". As shown in FIGS. 3, 4 and 10, two of the corners of end side panel 42 may be rounded.

The shape of carton 34 is defined by having the end sides panel 42 positioned substantially perpendicular to a plane in which top face 40 lies. Each lateral side panel 44 is defined by an intermediate panel 50 and a planar portion 52 which is parallel to and offset from the plane in which top face 40 lies. The planar portions 52 of the lateral side panels 44 preferably lie in a common plane parallel to the plane of top face 40. Intermediate panel 50 preferably is rectangular in shape having a length of approximately 9 1/16" and a width of approximately 13/16". One edge of the intermediate panel 50 is attached to lateral edge 46 while a parallel edge of panel .30 is attached to rectangular planar portion 52. Planar portion 52 has a length of approximately 9 1/16" and a width of approximately 1 3/8". Note that only one planar portion 52 may be needed depending on the intended purpose of carton 34.

Figure 9:
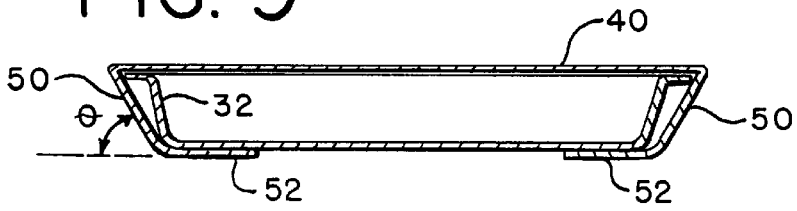
FIG. 9 shows a side cross-sectional view of an embodiment of the frozen food carton of FIGS. 1–8 when a side panel is angled.

As shown in FIGS. 1–8, the end side panels 42 and the intermediate panels 50 are preferably angled relative to the planar portions 52 by an angle θ of approximately 90°. FIG. 9 shows that the width of panel 50 can be increased so that the angle θ has a value varying from less than 180° to greater than 0°. The width of panel 42 can be increased in a similar fashion. Preferably, panels 42 and 50 are angled by an equal amount. Of course, the angle θ may have a different value for each panel 42 and 50. Furthermore, tray 32 may have its sides angled in a manner similar to panels 42 and 50.

The bottom 54 of carton 34 has a bounded opening 56 which is parallel to planar portions 52. The bounded opening 56 may have a variety of shapes including a polygon, such as a rectangle. Opening 56 is contained within a plane parallel to and offset relative to the plane in which the top face 40 lies. Opening 56 is bounded or defined by end edges 58 of end side panels 42 and end edges 60 of planar portions 52. Of course, it is possible for planar portions 52 to meet edge-to-edge.

The tray 32 can be loosely held within carton 34 or it can be attached to carton 34. If tray 32 is loosely held, tray 32 is supported on planar portions 52 and lidding material 38 is used to cover and seal the compartments as described previously. In another embodiment, tray 32 is inverted so that opening 56 is adjacent to the lidding material 38 and is supported on face 40.

Attachment of tray 32 to carton 34 can be accomplished in several ways. For example, a sealing material, such as a polyester dual ovenable coating, can be placed on the inner surface of top face 40 so as to be integral therewith. The sealing material is then heat sealed to flange 62 of tray 32. As described in U.S. Pat. No. 5,090,615, whose contents are incorporated herein by reference, tray 32 may be heat sealed to other polymeric coatings. In both embodiments where the tray 32 has a lidding material 38 or the tray 32 is heat sealed to the inside of the top face 40, the bottom 64 of tray 32 may be attached to one or both planar portions 32 by a hot melt adhesive as described in U.S. Pat. Nos. 5,090,615 and 5,234,159 whose contents are incorporated herein by reference. Also, cold vinyl adhesive or other attachment methods known in the art can be used.

Carton 34 is preferably constructed from a blank, such as foldable sheet 66, as shown in FIG. 10. Foldable sheet 66 has a top face 40 having four edges 46, 48. Side edges 48 have a length L and are attached to end side panels 42 which have a width having a value W. Lateral side panels 44 are attached to lateral edges 46. Each of the lateral side panels 44 preferably has a fold line 68 which separates two areas of the panel—a rectangular intermediate panel 50 having a width of value W and a rectangular area 52 having a width that is less than or equal to one half of the length, L, of side edge 48. It is also possible that the widths of panels 42 and 50 differ from each other.

Carton 34 is constructed by folding panels 42 and 44 so that they are perpendicular to top face 40. Planar portions 52 are then folded perpendicular to intermediate panels 50 so that they are parallel to top face 40. As shown in FIG. 9 and described previously, one or more side panels 42 or intermediate panels 50 may be angled relative to the top face 40 by angular amounts θ which are different than 90°.

After side panels 42 and 44 are folded as described above, pentagon shaped tabs 70 and trapezoid shaped tabs 72 are folded perpendicular to the intermediate panels 50 and planar portions 52, respectively. Each end of intermediate panels 50 is attached to a side of a tab 70 while the remaining four sides of each tab 70 are unattached. Tab 70 preferably has a height of approximately 5/8" and a width of approximately 13/16" where one of the sides is angled by approximately 55° relative to folding line 68. Each tab 72 has a width of approximately 1 3/8" and a height of approximately 19/32" where one side is angled approximately 8° relative to folding line 68. It is understood that there are many possible shapes for tabs 70 and 72 without departing from the spirit of the invention.

When folded, tabs 70 and 72 may lay within the interior of carton 34 and adjacent to end side panels 42. The tabs 70 and 72 may be attached to panels 42 in a well-known manner, such as by an adhesive or by a mechanical tab lock. Preferably, tabs 72 are adhesively attached to panels 42.

When the carton ensemble is complete, the tray 32 may be accessed by adding perforations and tearing them to remove the tray, as shown in FIG. 8.

Figure 11:
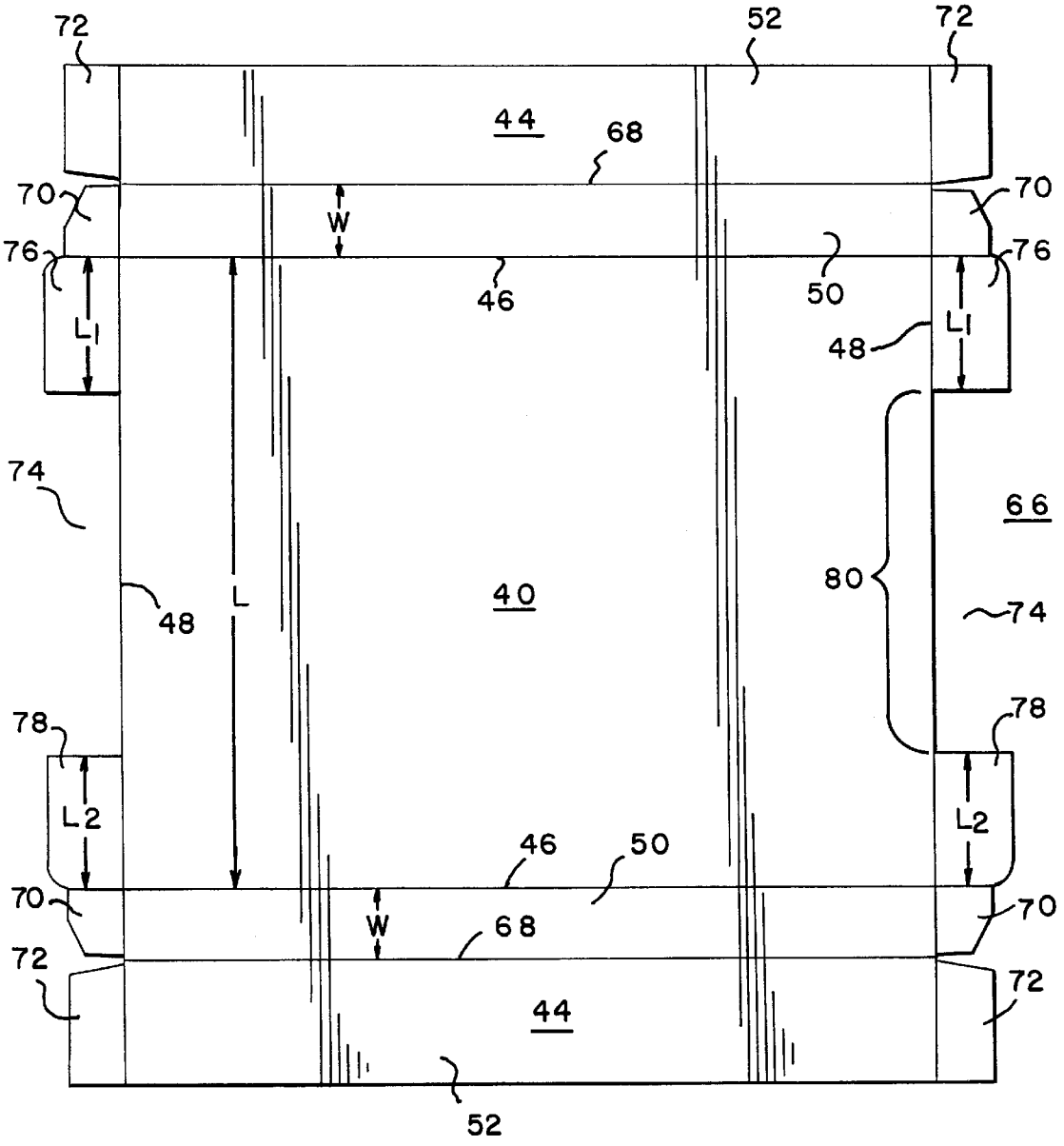
FIG. 11 shows an unfolded view of a second embodiment of a frozen food carton according to the present invention.
Figure 12A:
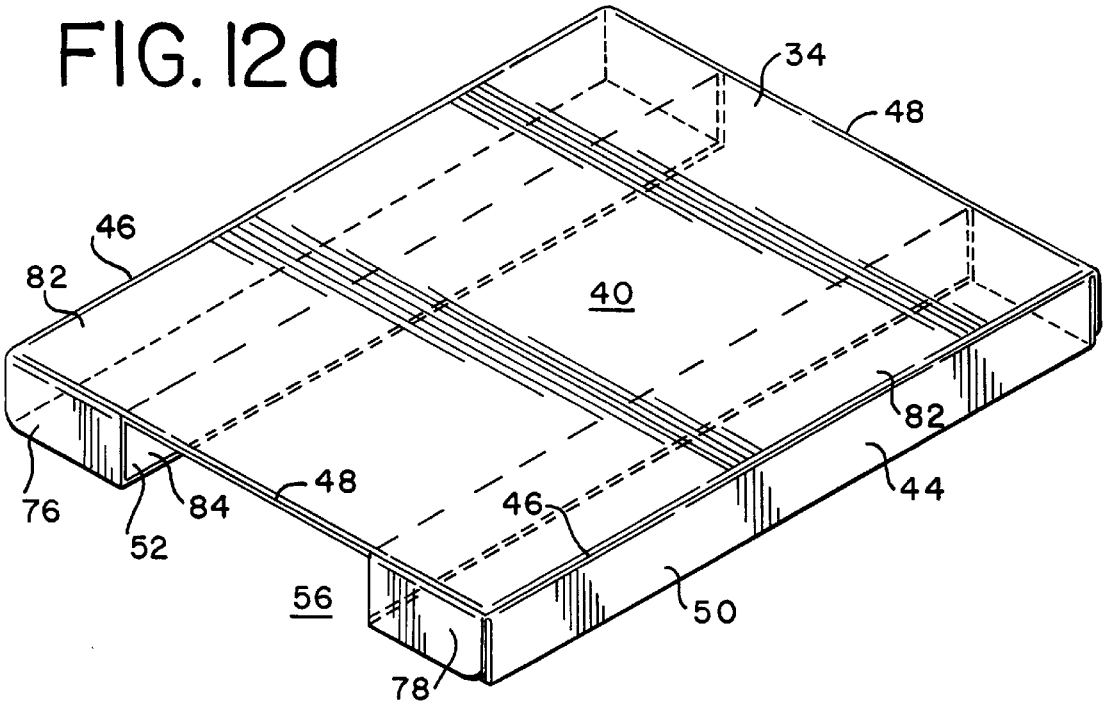
FIG. 12*a* shows a top perspective view of the frozen food carton of FIG. 11.
Figure 12B:
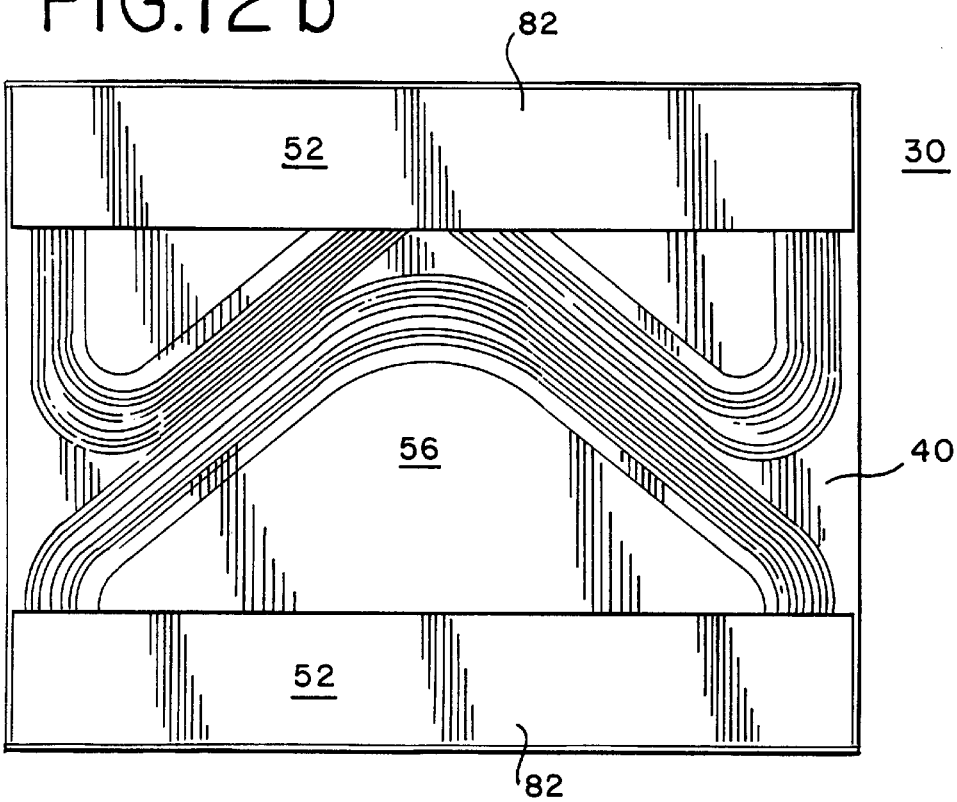
FIG. 12*b* shows a bottom view of the frozen food carton of FIG. 11.

Another embodiment of the present invention is shown in FIGS. 11 and 12*a–b*. The carton 34 has the same shape as shown as in FIGS. 1–10 and described above except that each of the end side panels 42 have a middle area or section 74 cut out therefrom. This leaves two flaps 76, 78 attached to each side edge 48. Each flap 76, 78 is rectangular-like in shape having a length of approximately 1 5/16" and a width of approximately 13/16". It is understood that flaps 76, 78 may have various shapes without departing from the spirit of the invention. For example, one or more corners of a flap may be rounded. As shown in FIG. 11, flaps 76 and 78 have lengths $L_1$, and $L_2$, respectively, which are less than the length, L, of side edge 48. Furthermore, flaps 76 and 78 are separated from one another by a portion 80 of side edge 48 which is unattached to other flaps and the like and has a length ($L-L_1-L_2$) of approximately 4 7/16". FIGS. 11 and 12 show that middle section 74 preferably is centrally located and has a rectangular shape having a length of approximately 4 7/16" and a width of approximately 13/16".

Construction of the carton of FIGS. 12*a–b* from the foldable sheet of FIG. 11 is accomplished in a manner similar to the construction of the carton of FIGS. 1–10. Flaps 76, 78 at each side edge 48 are folded so that they are perpendicular to top face 40. Planar portions 52 are then folded perpendicular to intermediate panels 50 such that they are parallel to top face 40. As described previously, one or more or flaps 76, 78 and/or intermediate panel 50 may be angled relative to the top face 40 by angular amounts θ which are different than 90°.

After the side panels 44 and flaps 76, 78 are folded as described above, pentagon shaped tabs 70 and trapezoid shaped tabs 72 are folded perpendicular to the intermediate panels 50 and planar portions 52, respectively. A tab 70 is attached to each end of intermediate panel 50. Each tab 70 preferably has four unattached sides and a height of approximately 5/8" and a width of approximately 13/16" where one of the sides is angled by approximately 8° relative to folding line 68. Each tab 72 has a width of approximately 1 3/8" and a height of approximately 19/32" where one side is angled approximately 9° relative to folding line 68. It is understood that there are many possible shapes for tabs 70 and 72 without departing from the spirit of the invention.

After being folded, tabs 70 and 72 may lay within the interior of carton 34 and adjacent to flaps 76 and 78. One or more of tabs 70 and 72 may be attached to flaps 76 and 78 in a well-known manner, such as by an adhesive or by a mechanical tab lock.

As shown in FIGS. 12*a–b*, carton 34 has a pair of C-shaped side pods 82 which are laterally spaced from one another and define a rectangular opening 56. Each side pod 82 is defined as including a portion (indicated by dashed lines) of top face 40, lateral edge 46, intermediate panel 50, planar portion 52 and flaps 76 or 78. A cross-section of a side pod 82 taken parallel to flaps 76, 78 reveals a C-type shape for the pod 82. The value of the width of the portion of the top face 40 is the same as that of the planar portion 52. Each side pod 82 defines an opening 84 which faces the opening 84 of the other side pod 82. Tray 32 (not shown) is then inserted into both of openings 84 and supported by planar portions 52 or attached to top face 40 in a manner described previously as to the embodiment of FIGS. 1–10.

Figure 13:
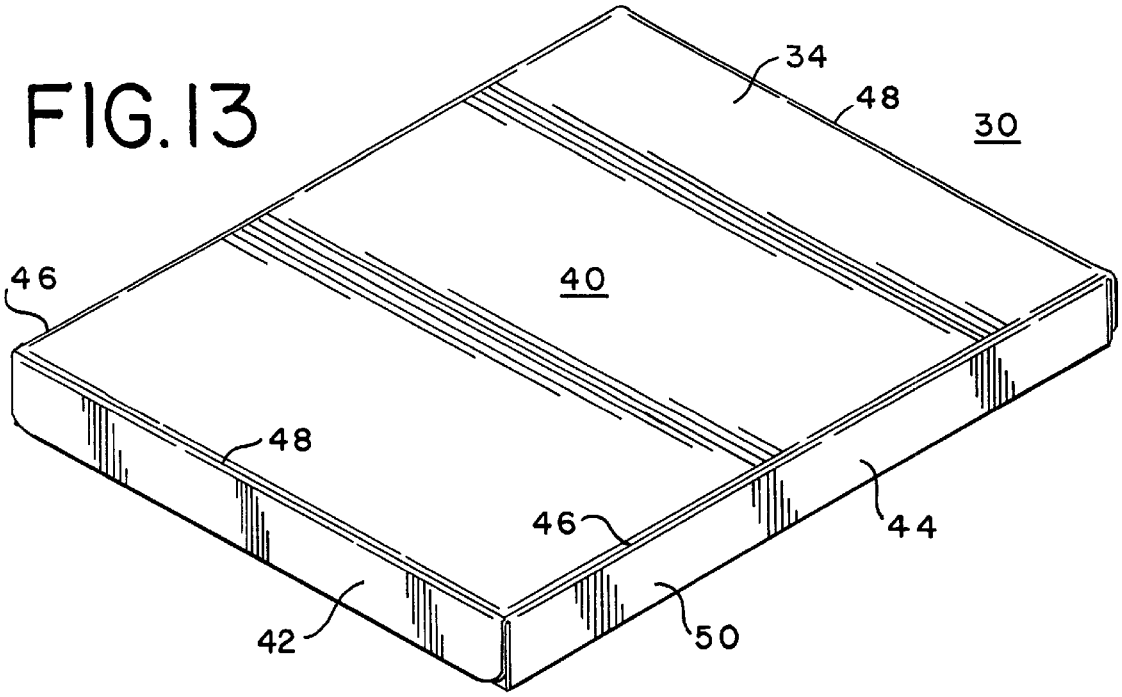
FIG. 13 shows a top perspective view of a third embodiment of a frozen food tray and carton ensemble according to the present invention.
Figure 14:
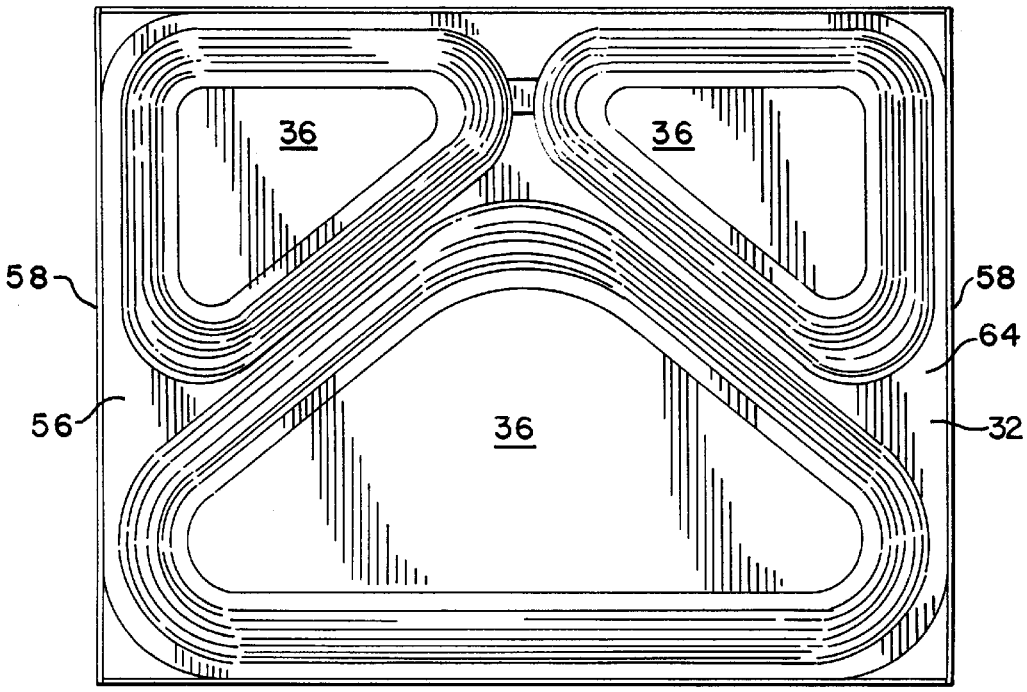
FIG. 14 shows a bottom view of the frozen food tray and carton ensemble of FIG. 13.
Figure 15:
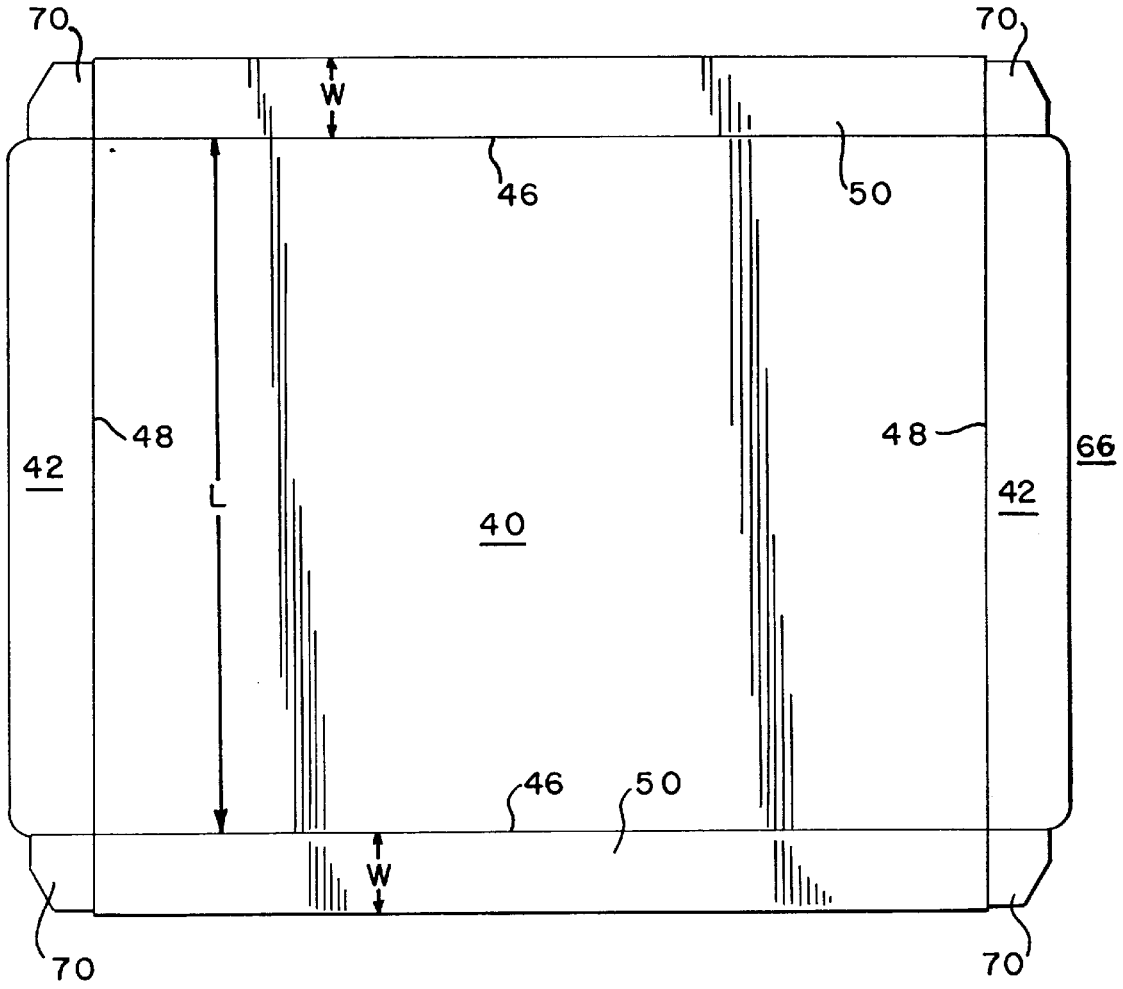
FIG. 15 shows an unfolded view of the frozen food carton of FIGS. 13 and 14.

A third variation of a tray and carton ensemble 30 is shown in FIGS. 13–15. The carton 34 of FIGS. 13–15 has the same construction as described above for the carton 34 of FIGS. 1–10 except that planar portions 52 are absent. The flanges 62 of tray 32 may be attached to the inner surface of top face 40 via a sealing material as described above. When planar portions 52 are removed, the bottom edges of end side panels 42 and lateral side panels 44 are unattached and may define a rectangular opening 56 having the same area as the top face 40. The width of panels 42 and 44 may have a value which is the same as the depth D of tray 32 (See FIGS. 16–17) or it can have a value greater or less than D, such as ½ D (See FIG. 18). Again, the side panels 42 and 44 may be angled as shown in FIG. 9, depending on the desired shape for the carton 34.

In the ensemble 30 of FIGS. 16–19, an alternative way of attaching tray 32 to the cartons 34 of FIGS. 13–15 is shown. This mode of attachment can be used alone or in conjunction with attachment to a sealing material placed on the inner surface of top face 40. If attachment by the sealing material is not chosen, then it is desired that the tray 32 is sealed by lidding material 38 as discussed earlier.

Figure 16:
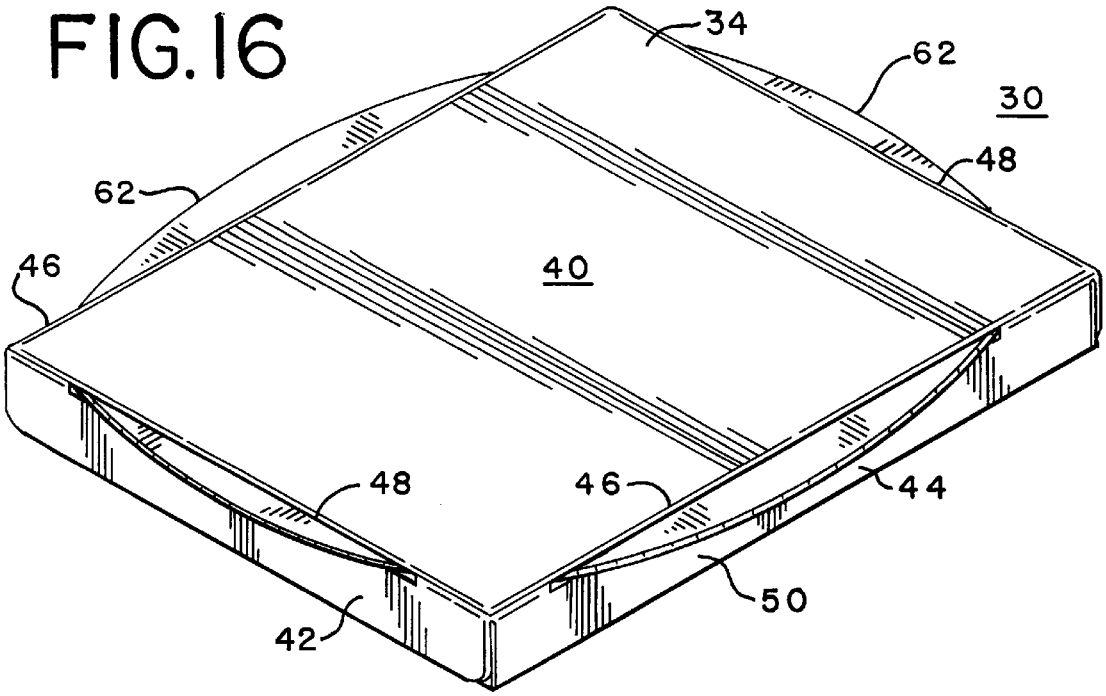
FIG. 16 shows a top perspective view of a fourth embodiment of a frozen food tray and carton ensemble according to the present invention.
Figure 17:
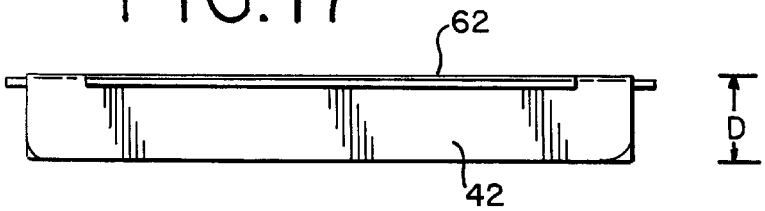
FIG. 17 shows a side view of the frozen food tray and carton ensemble of FIG. 16.

Attachment in FIG. 16 is accomplished by having one or more slots or perforations formed along edges 46 and 48. These slots are centrally located along the edges and are shaped so as to snugly receive portions of the flange 62 of tray 32. Once the flange 62 is inserted into the slots, the tray 32 is prevented from substantially moving relative to the carton 34.

Figure 18:
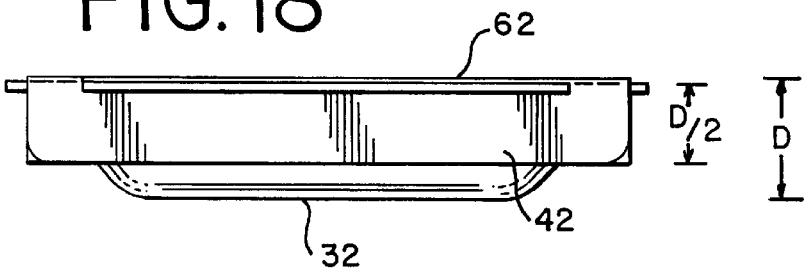
FIG. 18 shows a side view of a fifth embodiment of a frozen food tray and carton ensemble according to the present invention.
Figure 19:
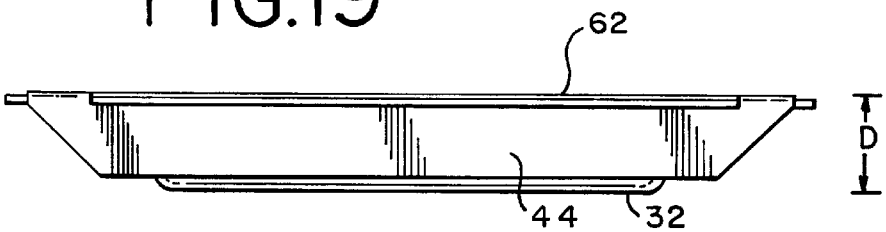
FIG. 19 shows a side view of a sixth embodiment of a frozen food tray and carton ensemble according to the present invention.

When tray 32 is inserted into the slots, the side panels 42 and 44 form a rectangular skirt about the sides of tray 32. The skirt of FIGS. 16 and 17 has a width which is equal to the depth, D, of tray 32. However, it is possible to vary the width of the side panels and skirt so that they have a width having a value greater or less than D, such as ½ D as shown in FIG. 18. In another variation, one or more side panels may be angled as well as shown in FIG. 19. While various shapes of tray 32 are possible for insertion into carton 34 of FIGS. 16–19, it is preferred that tray 32 has an oval shape. In such a case, flange 62 of tray 32 will extend beyond carton 34. However, it is possible to extend top face 40 so that it covers flange 62. Furthermore, it is possible to alter the shape of the skirt without departing from the spirit of the invention. For example, the skirt may be annular or have a polygonal shape as viewed looking from the bottom to the top.

While the embodiments of the invention disclosed herein are presently considered to be preferred, it is understood that various modifications and improvements can be made without departing from the spirit and scope of the invention. For example, it is understood that the present invention encompasses other shapes and sizes for the carton which depend on the tray to be placed therein. The shapes of the side panels may also vary. The planar portions 52 may be attached to the end side panels 42 instead of the lateral side panels 44. Furthermore, it is possible to eliminate tab 70 or tab 72 without departing from the spirit of the invention. In addition, both tray 32 and carton 34 may be made of materials that are heatable in either a conventional oven or a microwave oven, or alternatively, material suitable only for microwave heating. Another possibility is to use the attachment system of FIGS. 16–19 with the carton and tray ensemble of FIGS. 1–10. The scope of the invention is indicated in the appended claims and all changes which come within the meaning and range of equivalence of the claims are intended to be embraced therein.

We claim:

1. A carton for enclosing an object, comprising:

a top face defining a plane and comprising a first edge, a second edge, a third edge and a fourth edge;

a first side panel attached to said first edge and angled relative to said plane;

a second side panel attached to said second edge and angled relative to said plane;

a third side panel attached to said third edge and comprising a planar portion which is parallel to and offset from said plane;

a fourth side panel attached to said fourth edge;

wherein said first, second, third and fourth side panels each have an unattached edge, said unattached edges are coplanar and define an opening which is substantially parallel to said planar portion.

2. The carton of claim 1, wherein said opening is rectangular in shape.

3. The carton of claim 1, wherein said fourth side panel comprises a second planar portion which is parallel to and offset from said plane.

4. The carton of claim 3, wherein said second planar portion is substantially parallel to said planar portion.

5. The carton of claim 4, wherein said opening is rectangular in shape.

6. The carton of claim 1, wherein said edge of said third side panel is an edge of said planar portion.

7. The carton of claim 6, wherein said opening is rectangular in shape.

8. The carton of claim 3, wherein said edge of said third side panel is an edge of said planar portion; and said edge of said fourth side panel is an edge of said second planar portion.

9. The carton of claim 8, wherein said opening is rectangular in shape.

10. The carton of claim 1, wherein said first side panel is substantially perpendicular to said plane.

11. The carton of claim 10, wherein said second side panel is substantially per pendicular to said plane.

12. The carton of claim 1, wherein said first side panel is oriented at an angle of less than 90° relative to said plane.

13. The carton of claim 12, wherein said second side panel is oriented at an angle of less than 90° relative to said plane.

14. The carton of claim 1, wherein said third side panel comprises an intermediate panel attached to said third edge and said planar portion.

15. The carton of claim 14, wherein said intermediate panel is substantially perpendicular to said plane.

16. The carton of claim 14, wherein said intermediate panel is oriented at an angle of less than 90° relative to said plane.

17. The carton of claim 3, wherein said third side panel comprises an intermediate panel attached to said third edge and said planar portion.

18. The carton of claim 17, wherein said intermediate panel is substantially perpendicular to said plane.

19. The carton of claim 17, wherein said intermediate panel is oriented at an angle of less than 90° relative to said plane.

20. The carton of claim 17, wherein said fourth side panel comprises a second intermediate panel attached to said fourth edge and said planar portion.

21. The carton of claim 20, wherein said second intermediate panel is substantially perpendicular to said plane.

22. The carton of claim 20, wherein said second intermediate panel is oriented at an angle of less than 90° relative to said plane.

23. A foldable sheet, comprising:

a face defining a plane and comprising a first edge having a length L, a second edge, a third edge and a fourth edge;

a first rectangular side panel attached to said first edge and having a length extending from said third edge to said fourth edge;

a second rectangular side panel attached to said second edge and having a length extending from said third edge to said fourth edge;

a third side panel attached to said third edge, said third side panel comprises a first fold line defining a first area and a second area;

said first area is attached to said third edge and said first fold line;

said second area is attached to said first fold line and has a width that is less than one half of the length, L, of the first edge a fourth side panel attached to said fourth edge, said fourth side panel comprises a second fold line defining a third area and a fourth area;

said third area is attached to said fourth edge and said second fold line;

said fourth area is attached to said second fold line and has a width that is less than one half of the length, L, of the first edge.

24. The foldable sheet of claim 23, wherein said face is rectangular in shape.

25. The foldable sheet of claim 23, comprising a first tab attached to said first area and adjacent to said first side panel.

26. The foldable sheet of claim 25, wherein said tab has the shape of a pentagon.

27. The foldable sheet of claim 26, comprising a second tab attached to said second area and having the shape of a trapezoid.

28. A carton for enclosing an object, comprising:

a top face defining a plane and comprising a first edge having a length L, a second edge, a third edge and a fourth edge;

a first flap attached to said first edge having a length, $L_1$, which has a value less than L and angled relative to said plane;

a second flap attached to said first edge and having a length, $L_2$, which has a value less than $L-L_1$ and is angled relative to said plane;

said first and second flaps are separated from each other by a portion of said first edge which is unattached and has a length of $L-L_1-L_2$;

a second side panel attached to said second edge and angled relative to said plane;

a third side panel attached to said third edge and having a planar portion which is parallel to and offset from said plane; and a fourth side panel attached to said fourth edge.

29. The carton of claim 28, wherein said fourth side panel has a second planar portion which is parallel to and offset from said plane.

30. The carton of claim 28, wherein said third side panel comprises an intermediate panel attached to said third edge and said planar portion.

31. The carton of claim 30, wherein said intermediate panel is substantially perpendicular to said plane.

32. The carton of claim 30, wherein said intermediate panel is oriented at an angle of less than 90° relative to said plane.

33. The carton of claim 28, wherein said second edge has a length L;

a third flap attached to said second edge having a length, $L_1$, which has a value less than L and angled relative to said plane;

a fourth flap attached to s aid second edge and having a length, $L_2$, which has a value less than $L-L_1$ and is angled relative to said plane;

said third and fourth flaps are separated from each other by a portion of said second edge which is unattached and has a length of $L-L_1-L_2$.

34. A carton, comprising:

a top f ace defining a plane and having a first edge, a second edge, a third edge and fourth edge;

a first C-shaped pod which comprises a C-shaped panel attached to said top panel and defining a first C-shaped end and a second C-shaped end, a first tab attached to and covering s aid first C-shaped end and a second tab attached to and covering said second C-shaped end; and a second C-shaped pod which comprises said second edge and a second portion of said top face, wherein said first and second C-shaped pods each have openings which face each other.

35. The carton of claim 34, wherein said first C-shaped pod comprises a planar portion which is parallel to and offset from said plane.

36. The carton of claim 34, a second C-shaped pod which comprises a second C-shaped panel attached to said top panel and defining a third C-shaped end and a fourth C-shaped end, a third tab attached to and covering said third C-shaped end and a fourth tab attached to and covering said fourth C-shaped end.

37. The carton of claim 36, wherein said second C-shaped pod comprises a second planar portion which is parallel to and offset from said plane.

38. The carton of claim 37, wherein the openings have a rectangular-like shape.

39. A foldable sheet, comprising:

a face defining a plane and comprising a first edge having a length L, a second edge, a third edge and a fourth edge;

a first flap attached to said first edge having a length, $L_1$, which has a value less than L and angled relative to said plane;

a second flap attached to said first edge having a length, $L_2$, which has a value less than $L–L_1$ and is angled relative to said plane;

said first and second flaps are separated from each other by a portion of said first edge which is unattached and has a length of $L–L_1–L_2$;

a first side panel attached to said third edge, said third side panel comprises a first fold line defining a first area and a second area;

said first area is attached to said third edge and said first fold line;

said second area is attached to said first fold line and has a width that is less than one half of the length, L, of the first edge;

a second side panel attached to said fourth edge, said fourth side panel comprises a second fold line defining a third area and a fourth area;

said third area is attached to said fourth edge and said second fold line;

said fourth area is attached to said second fold line and has a width that is less than one half of the length, L, of the first edge.

40. The carton of claim 39, wherein said second edge has a length L;

a third flap attached to said second edge having a length, $L_1$, which has a value less than L and angled relative to sa id plane;

a fourth flap attached to said second edge and having a length, $L_2$, which has a value less than $L–L_1$ and is angled relative to said plane;

said third and fourth flaps are separated from each other by a portion of said second edge which is unattached and has a length of $L–L_1–L_2$.

41. The foldable sheet of claim 39, wherein said face is rectangular in shape.

42. A carton for enclosing an object, comprising:

a top face defining a plane and comprising a first edge, a second edge, a third edge and a fourth edge;

a first side panel attached to said first edge and angled relative to said plane;

a second side panel attached to said second edge and angled relative to said plane;

a third side panel attached to said third edge and comprising a planar portion which comprises a first end attached to said first side panel and a second end attached to said second side panel so that said planar portion is parallel to and offset from said plane; and a fourth side panel attached to said fourth edge and comprising a second planar portion which comprises a first end attached to said first side panel and a second end attached to said second side panel so that said planar portion is parallel to and offset from said plane.

43. The carton of claim 42, wherein said second planar portion is substantially parallel to said planar portion.

44. The carton of claim 42, wherein said third side panel comprises an intermediate panel attached to said third edge and said planar portion.

45. The carton of claim 44, wherein said intermediate panel is substantially perpendicular to said plane.

46. The carton of claim 44, wherein said intermediate panel is oriented at an angle of less than 90° relative to said plane.

47. The carton of claim 42, comprising:

a first tab attached to said first end of said planar portion and attached to said first side panel; and a second tab attached to said second end of said planar portion and attached to said second side panel.

48. The carton of claim 47, comprising:

a third tab attached to said first end of said second planar portion and attached to said first side panel; and a second tab attached to said second end of said second planar portion and attached to said second side panel.

* * * * *